US007311803B2

(12) United States Patent
Danielsson et al.

(10) Patent No.: US 7,311,803 B2
(45) Date of Patent: Dec. 25, 2007

(54) DISTRIBUTION OF A FLOWING MEDIUM

(75) Inventors: Magnus Danielsson, Matfors (SE); Jörgen T. Lundberg, Östersund (SE)

(73) Assignee: Metso Paper, Inc. (FI)

( * ) Notice: Subject to any disclaimer, the term of this patent is extended or adjusted under 35 U.S.C. 154(b) by 617 days.

(21) Appl. No.: 10/486,575

(22) PCT Filed: Jun. 28, 2002

(86) PCT No.: PCT/SE02/01286

§ 371 (c)(1),
(2), (4) Date: Feb. 11, 2004

(87) PCT Pub. No.: WO03/016618

PCT Pub. Date: Feb. 27, 2003

(65) Prior Publication Data

US 2004/0238141 A1 Dec. 2, 2004

(30) Foreign Application Priority Data

Aug. 15, 2001 (SE) ..... 0102750

(51) Int. Cl.
*D21F 1/00* (2006.01)

(52) U.S. Cl. ..... 162/213; 162/254; 162/259; 162/315; 162/336; 118/232

(58) Field of Classification Search ..... 162/213, 162/254, 259, 315, 336; 118/232
See application file for complete search history.

(56) References Cited

U.S. PATENT DOCUMENTS

| | | | | |
|---|---|---|---|---|
| 5,381,341 | A * | 1/1995 | Herrala et al. | 700/129 |
| 5,571,383 | A * | 11/1996 | Fredriksson et al. | 162/213 |
| 5,603,806 | A * | 2/1997 | Kerttula | 162/198 |
| 6,284,100 | B1 * | 9/2001 | Shakespeare et al. | 162/198 |

FOREIGN PATENT DOCUMENTS

| | | |
|---|---|---|
| DE | 34 25 129 A1 | 1/1986 |
| SE | 500 546 C2 | 7/1994 |

* cited by examiner

*Primary Examiner*—Mark Halpern
(74) *Attorney, Agent, or Firm*—Lerner, David, Littenberg, Krumholz & Mentlik, LLP

(57) ABSTRACT

Methods for uniformly distributing a flowing medium to a surface such as that of a rotary liquid permeable roll are disclosed where the flowing medium is distributed by a number of distribution units, the method including distributing the flowing medium to each of the distribution units and separately controlling the flow of the flowing medium to each of the distribution units whereby a uniform flow and an equal amount of the flowing medium is obtained in each of the distribution units. Distribution devices for uniformly distributing a flowing medium to such a surface are also disclosed.

3 Claims, 1 Drawing Sheet

DISTRIBUTION OF A FLOWING MEDIUM

This application is a 371 of PCT/SE02/01286 filed 28 Jun. 2002.

FIELD OF THE INVENTION

The present invention relates to a method and a device for the uniform spreading and distribution of a flowing medium, for example a pulp suspension, where the medium is distributed by at least two distribution units.

BACKGROUND OF THE INVENTION

As an example, the present invention can be applied to the field of cellulose, and the need of the papermaking industry to form webs of fibrous suspensions, which are often more than 10 meters wide and have very high requirements for uniformity both across and along the manufacturing direction. The uniformity of the webs is often totally decisive for the efficiency and economy of the process.

During, for example, liquid treatment, i.e. washing or bleaching and dewatering of fibrous suspensions, it is essential that the pulp is applied to and distributed transversely on a continuous liquid permeable support as uniformly as possible, both in the longitudinal and transverse direction. It is equally essential that the treatment liquid is distributed uniformly across the pulp web. A uniform distribution prevents channelization and thereby non-uniform liquid treatment and dewatering.

In order to make optimum use of the equipment, a suspension of cellulose fibers to be dewatered, for example in connection with a liquid treatment, must be supplied at the highest possible concentration and be formed on the support, through which liquid is sucked out. This support can be a liquid permeable roll or a plane wire.

The question of highest possible concentration is determined by the capacity of the device to transversely distribute the medium sufficiently uniformly and to form a homogenous web in order to satisfy the demand of the process in question. The difficulty of distributing the fibrous suspension uniformly, across the entire width increases rapidly with increasing pulp concentration as a consequence of the increasing shearing strength of the fiber network.

Non-uniform distribution of the fibrous suspension not only results in non-uniform dewatering and thereby poor efficiency of the liquid treatment, it can also cause in a press damages on the fibers and, thus, deteriorated pulp quality. In the roll nip between the rolls, for example in a roll press, fiber flocks and thick portions of the pulp web can be subjected to compacting pressures so high that the fibers are damaged in these load-carrying portions.

It is thus apparent that a uniform distribution of the fibrous suspension and treatment liquid is of greatest importance for the quality of the final product and economy of the process.

One type of distribution unit used during the distribution of fibrous suspension is described in Swedish patent specification No. SE 500,546. The distribution unit in that case comprises a distribution housing with a wide outlet opening and a pipe for the supply of the suspension to the distribution housing. In the distribution housing the suspension is deflected and simultaneously spread in the lateral direction, and thereafter deflected again in a passage bent in the transverse direction. Such a distribution unit delivers a uniformly distributed and parallel flow.

In order to form a web of up to 10 meters width, and even greater width, several distribution units are required. Each distribution unit of the type described in Swedish patent specification No. 500,546 normally is about 0.9 m wide, but today they are found to have widths of up to about 2 meters.

For supply of the suspension to the distribution units, a head box is provided substantially along the entire width of the web. The head box acts as a large equalizing box, in which the pulp shall be uniformly distributed. The head box has an outlet for each distribution unit. From each outlet a pipe extends to its distribution unit.

With such a device of a known type, problems arise in that the pulp web becomes non-uniform as seen along the entire width of the web. Each distribution unit brings about a uniform web, but the different distribution units between themselves do not bring about exactly equal webs. Problems also arise because the distribution units at times can plug.

One object of the present invention is to offer a method and a device for uniformly spreading and distributing a flowing medium to a web, for example a web of pulp suspension, where the medium is distributed by means of at least two distribution units. As mentioned above, the uniformity of the web is fully decisive for the efficiency and economy of the process.

It has thus been found that the head box at times does not deliver the same flow in all outlets.

The flow distribution is achieved by static throttlings. During pulp flow a pressure drop is created above the throttling of the respective outlet. It is this pressure drop which produces the distribution of the pulp between the different outlets. Particularly during low flows the pressure drop created in the throttlings becomes too low for providing a good distribution. This, in turn, results in the different distribution units not being fed fully equally which, of course, results in a non-uniform web.

It is also due to the non-uniform distribution from the head box to the distribution units that the distribution units can plug.

SUMMARY OF THE INVENTION

In accordance with the present invention, these and other objects have now been realized by the discovery of a method for uniformly distributing a flowing medium to a predetermined surface wherein the flowing medium is distributed by a plurality of distribution units, the method comprising distributing the flowing medium to each of the plurality of distribution units and separately controlling the flow of the flowing medium to each of the plurality of distribution units whereby a uniform flow and an equal amount of flow of the flowing medium is obtained in each of the plurality of distribution units.

In accordance with the present invention, a distribution device for uniformly distributing a flowing medium to a predetermined surface has been discovered comprising a plurality of distribution units, each of the plurality of distribution units including a distribution housing including an outlet opening, a supply pipe for supplying the flowing medium to the plurality of distribution units, a flow controller for the supply pipe, and a common control unit for controlling each of the flow controllers for the plurality of distribution units for controlling the flow of the flowing medium therein.

In accordance with one embodiment of the distribution device of the present invention, each of the plurality of distribution housings includes a diverging distribution chamber substantially transverse to the supply pipe, a passage substantially transverse to the diverging distribution chamber whereby the distribution chamber connects the supply pipe to the passage, an outlet chamber substantially transverse to the passage for receiving the flowing medium from the passage, and an outlet for the outlet chamber, whereby the flowing medium is deflected to a substantially uniformly parallel flow at the outlet.

In accordance with one embodiment of the distribution device of the present invention, the distribution device includes upper entry means for supplying the flowing medium to each of the plurality of distribution housings from above.

In accordance with another embodiment of the distribution device of the present invention, the distribution device includes connection means for directly connecting each of the plurality of supply pipes to a pulp tower.

In accordance with another embodiment of the distribution device of the present invention, the distribution device includes dewatering means comprising at least one rotary liquid permeable roll, whereby the distribution device distributes the flowing medium uniformly onto the at least one rotary liquid permeable roll.

In accordance with the present invention, the above objects are achieved by each distribution unit being separately fed with suspension by means of a pipe with flow control, for example by means of valves, which are controlled by a control system.

In this manner a uniform feed to each distribution unit is ensured and can also be controlled, so that a uniform distribution between the different distribution units is obtained. This means that to all distribution units an equally large flow is obtained.

In this manner the head box can be abolished, which implies several further advantages. A roll press of conventional type comprises two rotary rolls, which between them form a nip for dewatering the suspension. The rolls are mounted in a trough. In order not to block the way when there is need to have access to the press from above, the head box was normally placed outside the trough, and the distribution housing was supplied with suspension from below and outside the trough. The trough has a certain extension, as seen radially, outwardly from the rolls. As a result, the distribution unit must comprise a transport channel for transport of the suspension from the outlet opening to the surface where the pulp web shall be formed (the rolls). The longer this transport channel is, the greater becomes the plugging risk.

According to the present invention, the distribution housing is fed from above. The pipes, through which the suspension is supplied, do not hinder access to the press, if such access is required. The transport channel of the distribution unit can thereby be given a shorter length whereby the transport distances become shorter and the plugging risk is thus reduced.

In the device according to the present invention, as stated above, there is no need for a head box. The design of the trough has been dependent upon the head box, because they often must constitute one unit together, or in any case must be arranged adjacent to one another. The fact that the head box is not needed renders it much easier to design an acceptable trough, which is important because the trough is a bearing part.

BRIEF DESCRIPTION OF THE DRAWINGS

A preferred embodiment of the present invention will be described in the following detailed description, with reference to the accompanying drawings, where.

DETAILED DESCRIPTION

Figure 1:
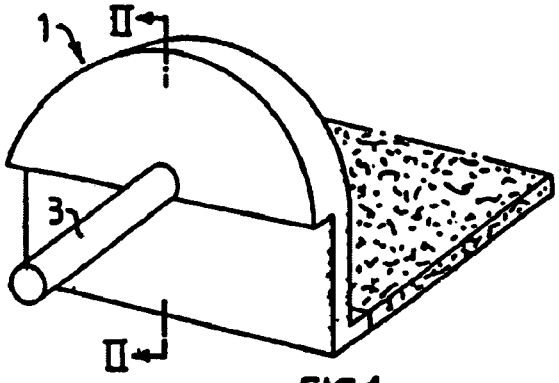
FIG.1 PRIOR ART
FIG. 1 is a front, perspective view of a distribution unit in accordance with the prior art.
Figure 2:
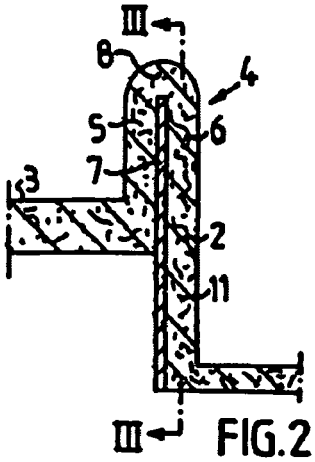
FIG.2 PRIOR ART
FIG. 2 is a side, elevational, sectional view of the distribution unit shown in FIG. 1, taken along II-II thereof.
Figure 3:
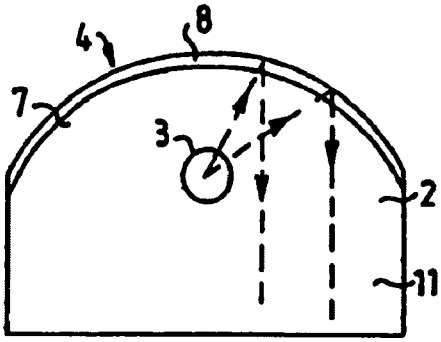
FIG.3 PRIOR ART
FIG. 3 is a front, elevational, sectional view of the distribution unit shown in FIG. 2 taken along III-III thereof.

FIGS. 1, 2 and 3 show a distribution unit 1 of the type described in Swedish patent specification No. 500,546. The distribution unit 1 is intended for transverse distribution and forming a web of a flowing medium, for example a pulp web of a fibrous suspension. The distribution unit will be described only roughly, because it is known per se. The distribution unit 1 comprises a distribution housing 4 with a wide substantially rectangular outlet opening 2 and a supply pipe 3 for the fibrous suspension.

The outlet opening 2 transforms to a transport channel 11, which has a width equal to the outlet opening 2 and is intended to transport the suspension from the outlet opening 2 to the place where the pulp web shall be formed.

The distribution housing 4 is formed with a distribution chamber 5, which is located substantially transversally to the supply pipe 3 and extends from the connection of this pipe 3 diverging in the direction to a passage 8 bent in the transverse direction. The distribution housing 4 further comprises an outlet chamber 6, which extends in the opposite direction from the deflection at the passage 8 to the outlet opening 2. The two chambers, 5 and 6, are separated by an inner wall 7 in the housing 4 and communicate with each other by means of the passage 8. The medium is thereby deflected to a substantially uniformly distributed parallel flow at the outlet opening 2.

Figure 4:
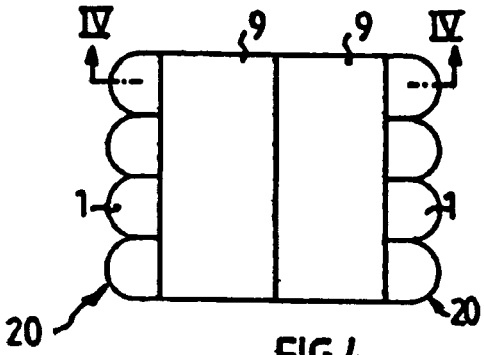
FIG. 4 is a schematic view of the principle of a dewatering device with distribution means according to the present invention.

FIG. 4 shows in principle a dewatering device seen from above. (The dewatering devices referred to in the Figures are of the type described, for example, in Swedish patent specification No. 509,519. The dewatering device comprises at least one rotary liquid permeable roll.) The dewatering device comprises two liquid permeable rolls 9 and for each roll 9 a distribution device 20 for distributing a fibrous suspension on the roll 9.

It appears from FIG. 4, that the embodiment of a distribution device 20 comprises four distribution units 1. A distribution device 20 can, of course, comprise more or fewer distribution units 1. The number required is determined by the width of each outlet opening 2 (the width of the distribution unit 1) and by the width of the web to be produced. With distribution units 1 of 1 meter width and a roll 9 of 5 meter length, thus, five distribution units 1 are required in order to obtain a pulp web over the entire length of the roll 9.

Figure 5:
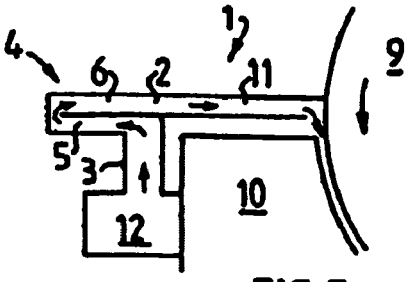
FIG.5 PRIOR ART
FIG. 5 is a side, elevational, sectional view taken along IV-IV of FIG. 4 with the distribution device formed according to prior art.

FIG. 5 is a sectional view along IV-IV in FIG. 4 where the distribution device is formed according to the prior art. Only half the dewatering device is shown, however, because it is symmetrical.

The distribution device comprises a head box 12, which substantially extends along the entire length of the roll 9. The head box 12 is located outside a trough 10, in which the roll 9 is mounted.

The pulp suspension is fed to the head box 12, for example from a pulp tower, which is not shown. The suspension is distributed in the head box 12 and fed from below into each distribution unit 1 through its pipe 3 to the distribution chamber 5 of the distribution housing 4 and further through the distribution chamber 6 to the outlet opening 2 and further through the transport channel 11 according to the arrows in the Figure. The transport channel 11 opens at the surface of the roll 9 where the pulp web is formed. The length of the transport channel 11 depends on the design of the trough 10.

Figure 6:
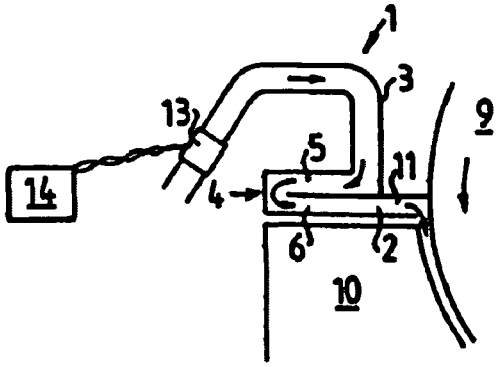
FIG. 6 is a side, elevational, sectional view taken along IV-IV of FIG. 4 with the distribution device formed according to the present invention.

FIG. 6 is a sectional view as in FIG. 5, but in this case where the distribution device 20 is formed according to the present invention. Each distribution unit 1 comprises a supply pipe 3 with a flow controller 13. All flow controllers 13 are connected to a common control unit 14 for controlling the flow. By means of the control unit 14 the flow can be controlled so that all distribution units 1 receive a uniform supply of suspension, and that the different distribution units 1 between themselves receive a uniform flow of suspension.

Each supply pipe 3 is connected from above to its distribution housing 4. The closer the supply pipe 3 is located to the roll 9, the shorter transport channel 11 is required. In the case when the supply pipe 3 is located immediately adjacent the roll, no transport channel 11 is required.

No head box 12 is provided, but the pulp suspension is fed directly, suitably by means of a pump, from, for example, a pulp tower to each distribution unit 1 through its pipe 3. The term direct is to be understood here also so that a pipe can extend from the tower, which then branches to a pipe 3 to each distribution unit 1.

As appears by comparison between FIGS. 5 and 6, the transport channel 11 is shorter with a design according to FIG. 6. The transport distance of the suspension and the risk of plugging are thereby reduced.

A distribution device according to the invention can also comprise a head box.

The flow controllers are then located after the head box. This provides a uniform and equally distributed flow to the distribution units, but is not a preferred embodiment.

Although the present invention is illustrated with a device for the distribution of a pulp suspension, it is apparent that the invention is also applicable to other flowing media where a uniform distribution is desired. One example thereof is the supply of treatment liquid over a material web.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for uniformly distributing a flowing medium to a predetermined surface for dewatering said flowing medium wherein said flowing medium is distributed by a plurality of distribution units to a dewatering means comprising at least one rotary liquid permeable roll, said method comprising distributing said flowing medium to each of said plurality of distribution units from above from a plurality of supply pipes connected to a pulp tower and separately controlling the flow of said flowing medium to each of said plurality of distribution units whereby a uniform flow and an equal amount of flow of said flowing medium is obtained in each of said plurality of distribution units and said uniform flow is distributed uniformly onto said at least one rotary liquid permeable roll.

2. A distribution device for uniformly distributing a flowing medium to a dewatering means comprising a plurality of distribution units, each of said plurality of distribution units including a distribution housing including an outlet opening, upper entry means for supply said flowing medium to each of said plurality of distribution housings from above, a supply pipe for supplying said flowing medium to said plurality of distribution units, connection means for directly connecting each of said plurality of supply pipes to a pulp tower, a flow controller for said supply pipe, a common control unit for controlling each of said flow controllers for said plurality of distribution units for controlling the flow of said flowing medium, and dewatering means comprising at least one rotary liquid permeable roll, whereby said distribution device distributes said flowing medium uniformly onto said at least one rotary liquid permeable roll.

3. The distribution device of claim 2 wherein each of said plurality of distribution housings includes a diverging distribution chamber substantially transverse to said supply pipe, a passage substantially transverse to said diverging distribution chamber whereby said distribution chamber connects said supply pipe to said passage, an outlet chamber substantially transverse to said passage for receiving said flowing medium from said passage, and an outlet for said outlet chamber, whereby said flowing medium is deflected to a substantially uniformly parallel flow at said outlet.

* * * * *

UNITED STATES PATENT AND TRADEMARK OFFICE

CERTIFICATE OF CORRECTION

PATENT NO. : 7,311,803 B2
APPLICATION NO. : 10/486575
DATED : December 25, 2007
INVENTOR(S) : Magnus Danielsson and Jörgen T. Lundberg It is certified that error appears in the above-identified patent and that said Letters Patent is hereby corrected as shown below:

Title Page;
On the face of the patent, (57) ABSTRACT, line 8, delete "is" and insert therefor --are--.
Column 1, line 36, "plane" should read --plain--.
Column 1, line 42, delete ",".
Column 2, line 49, delete "is" and insert therefor --are--.
Column 6, line 20, delete "is" and insert therefor --are--.
Column 6, line 29, after "supply" insert --of--.

Signed and Sealed this

Sixth Day of May, 2008

JON W. DUDAS
*Director of the United States Patent and Trademark Office*